United States Patent [19]

Laflamme

[11] 4,340,879

[45] Jul. 20, 1982

[54] PERSONNEL IN AND OUT INDICATOR

[76] Inventor: Daniel Laflamme, 1490 - 1500 W. Gerogia St., British Columbia, Canada, V6G 2Z6

[21] Appl. No.: 216,448

[22] Filed: Dec. 15, 1980

[51] Int. Cl.[3] ..... G08B 5/36

[52] U.S. Cl. ..... 340/286 R; 340/256 M; 346/14 R; 346/47

[58] Field of Search ..... 340/286 R, 286 M, 309.1, 340/309.4; 346/14, 47

[56] References Cited

U.S. PATENT DOCUMENTS 3,596,277 7/1971 DeWitt ..... 346/47

*Primary Examiner*—Harold I. Pitts

*Attorney, Agent, or Firm*—Burke-Robertson, Chadwick & Ritchie

[57] ABSTRACT

A personnel in and out indicator device which is programmable with information regarding the in or out status and time of arrival or departure of employees at a location. The device consists of a frame on which are mounted a series of manually operable personnel indicating switches. Each of such switches represents a particular person or persons in respect of which information is to be recorded or displayed. A further series of manually operable switches is exposed on the frame, each of these switches representing a particular time. A memory means is electrically associated with the personnel indicating and time indicating switches to receive and store information received from these switches. Information retrieval means, electrically associated with the memory means and personnel indicating switches, is provided which is actuable upon selection of a personnel indicating switch, to retrieve information stored in the memory means with respect to that person or persons and display it at a time display means visibly located on the frame of the device. A switch means is provided to actuate the information retrievel means. Such a device provides a simple, compact system for readily displaying in-out status information in respect of a firm's personnel to be used for example in a reception area.

7 Claims, 4 Drawing Figures

PERSONNEL IN AND OUT INDICATOR

BACKGROUND OF THE INVENTION

This invention relates to a personnel status board which is programmable with information regarding the arrival or departure of employees on various shifts whose names are recorded thereon.

Such personnel call boards have heretofore been largely mechanical, and hence suitable for a small number of employees, and becoming large, cumbersome and awkward where information is kept regarding a large number of employees. Canadian Pat. No. 810,444 of Lahmer issued Apr. 15, 1969 (U.S. Pat. No. 3,645,227)describes one such mechanical device wherein the holes of a peg board-like structure are illuminated as required opposite in-out and time designations along one axis to indicate the status of personnel listed along the other.

Other patents of general background interest include U.S. Pat. No. 3,594,778 of Herold et al. issued July 20, 1971 in which a computerized display board for address locations is described and illustrated; U.S. Pat. No. 3,214,747 of Lurie issued Oct. 26, 1965 in which a signalling system to indicate for example unit status at a plurality of stations in a hospital is taught; U.S. Pat. No. 3,599,200 of Bunting issued Aug. 10, 1971 in which a signal board used as a doctor's register is disclosed; U.S. Pat. No. 3,962,698 of Hunt issued June 8, 1976 in which a remote control and display panel for eating establishments is described, wherein orders as to items and quantities per item, for a number of customers, is fed into a composite memory system and displayed on a panel so the chef can perceive the same.

None of these prior devices however is suitable for use in storing information as to the time of arrival or departure of a large number of personnel, as is the object of the present invention.

SUMMARY OF THE INVENTION

In accordance with the present invention, a personnel call board which is programmable with information regarding in and out status and arrival and departure time of personnel at a location is provided. The device comprises a frame on which is mounted a series of manually operable personnel indicating switches. Each switch represents a particular person (or persons on different shifts where several shifts are involved) in respect of which information is to be recorded or displayed and each of these switches are actuable exclusive of the others. A further series of manually operable time indicating switches are exposed on the frame in which each switch represents a particular time, and each switch is actuable exclusive of the others. The device also comprises a memory means which is electrically associated with the personnel indicating and time indicating switches in order to receive and store information received from these switches. Information retrieval means is electrically associated with the memory means and personnel indicator switches, and actuable upon selection of a personnel indicating switch, to retrieve information stored in the memory means with respect to that person and display it at a time display means visibly located on the frame. The device further comprises a switch means to actuate the information retrieval means.

The memory means of the device is preferably a series of latching circuits, one for each person in respect of which information is to be recorded. Each latch is able to be output enabled and input gated by actuation of its corresponding personnel indicating switch.

It will be understood that information concerning a large number of personnel may be stored and displayed in more compact form than would be the case if such information had to be set out in permanent column fashion for each employee in a list of employees. As well, information stored in the memory may be readily and accurately recalled and displayed in a simple, easy to read fashion at the display means, for example by means of LED's representing each position and time sought to be displayed.

It will also be understood that, in addition to the structure of the invention as previously described, further components and circuitry might be added to provide more detailed information as to personnel, for instance whether or not they are in conference, on holidays, or whether they are at a particular location on the premises in question or elsewhere.

BRIEF DESCRIPTION OF THE DRAWINGS

These and other objects and advantages of the present invention will be more fully understood by referring to the acompanying drawings in which.

DETAILED DESCRIPTION OF THE INVENTION

Figure 1:
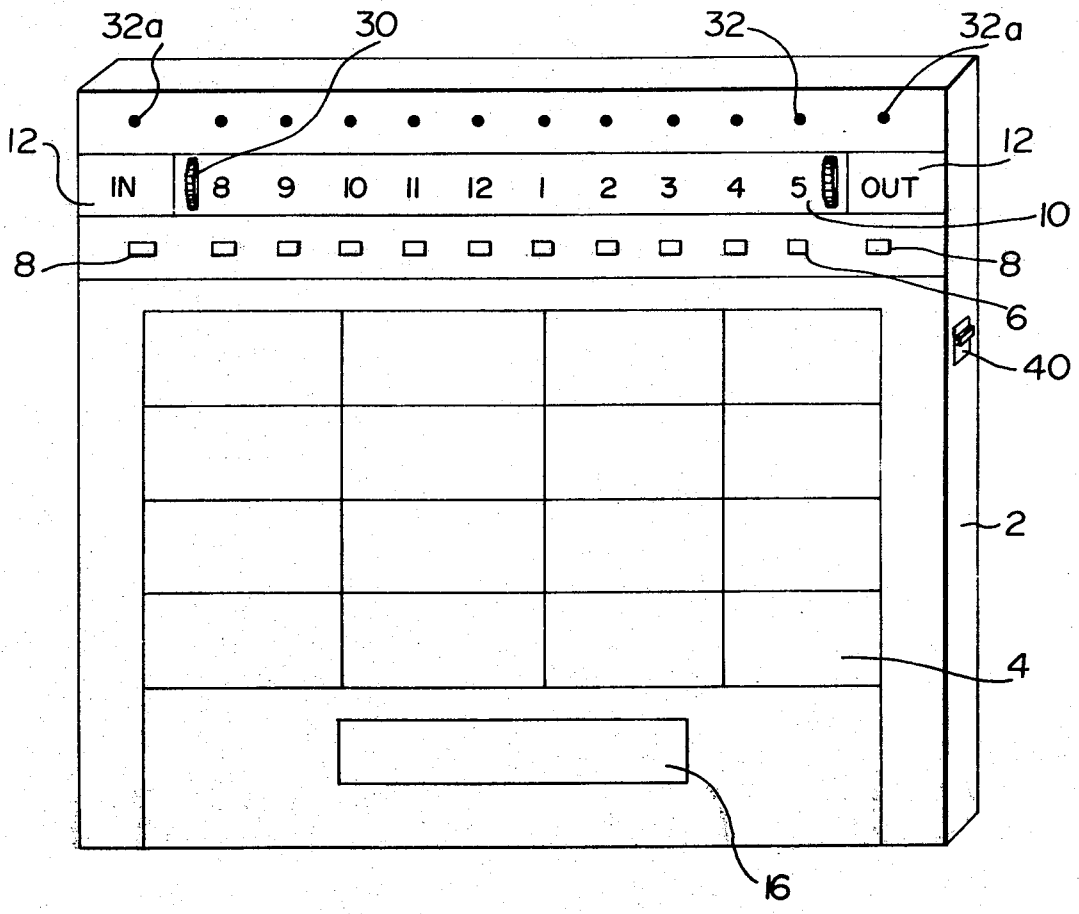
FIG. 1 is a perspective view of a personnel call board according to the present invention.
Figure 3:
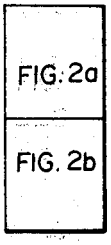
FIG. 3 indicates this relationship of FIGS. 2*a* and 2*b*.

In the drawings similar features have been given similar reference numerals.

As can be seen in FIG. 1, the device may be in the form a box-like call board which for example sit at a reception area of a firm. The device is made up of frame 2, on the front of which are a series of touch sensitive personnel indicating switches 4, each of such switches represent the name of a particular person in respect of which information is to be recorded or displayed. Where several shifts are involved the name of persons on different shifts may be represented on each such switch. Switches 4 are only actuable exclusively of other such switches. A further series of switches 6 are provided, these being time indicating switches, each representing a particular time. Again each of these switches is actuable exclusively of other time indicating switches 6. Beside the time indicating switches are in-out indicating switches 8. Juxtaposed beside time indicating switches 6 and in-out indicating switches 8 are appropriate time displays 10 and in-out lettered displays 12.

Memory activation switch 16 is provided to activate memory means 20 when it is desired to store information in the device, in a manner which will be hereinafter more fully described.

Figure 2A:
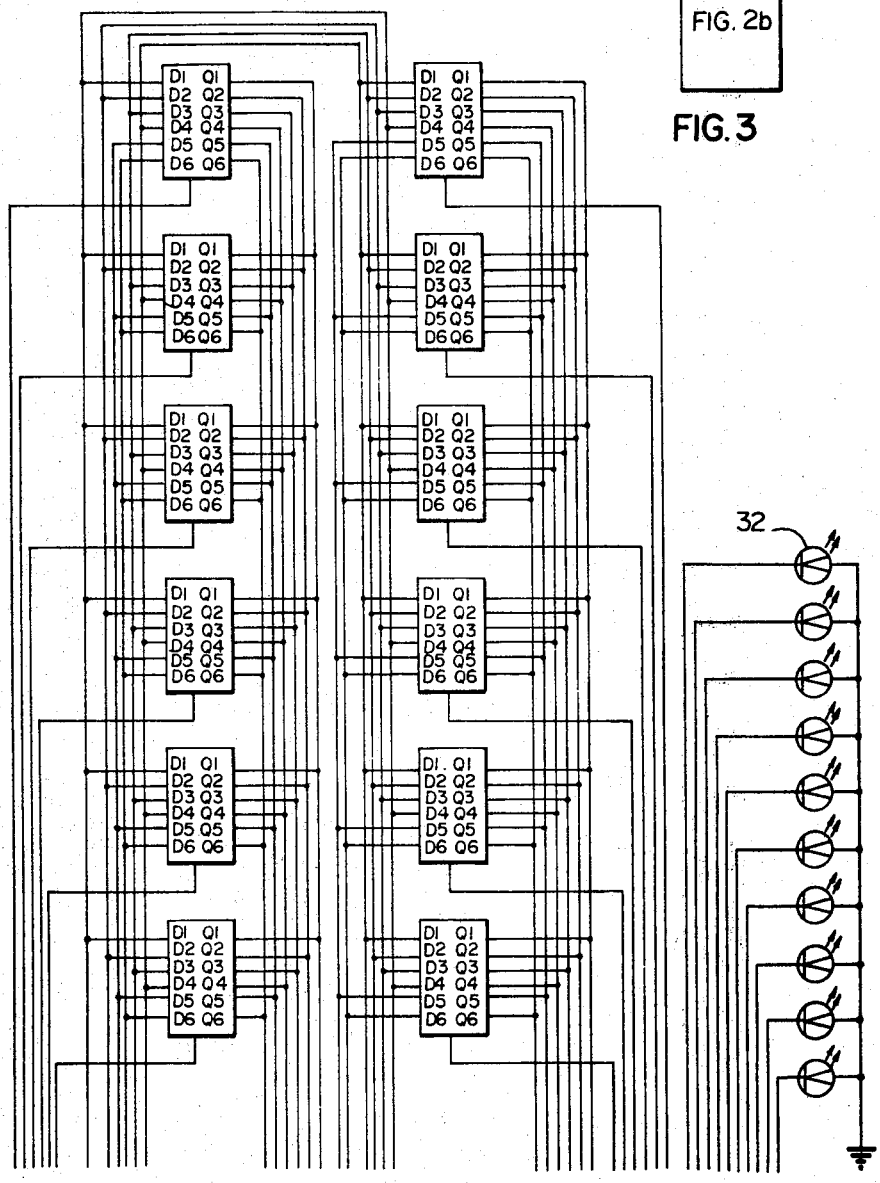
FIGS. 2*a* and 2*b* are a schematic diagram showing an example of circuitry for such an electronic call board as illustrated in FIG. 1.
Figure 2B:
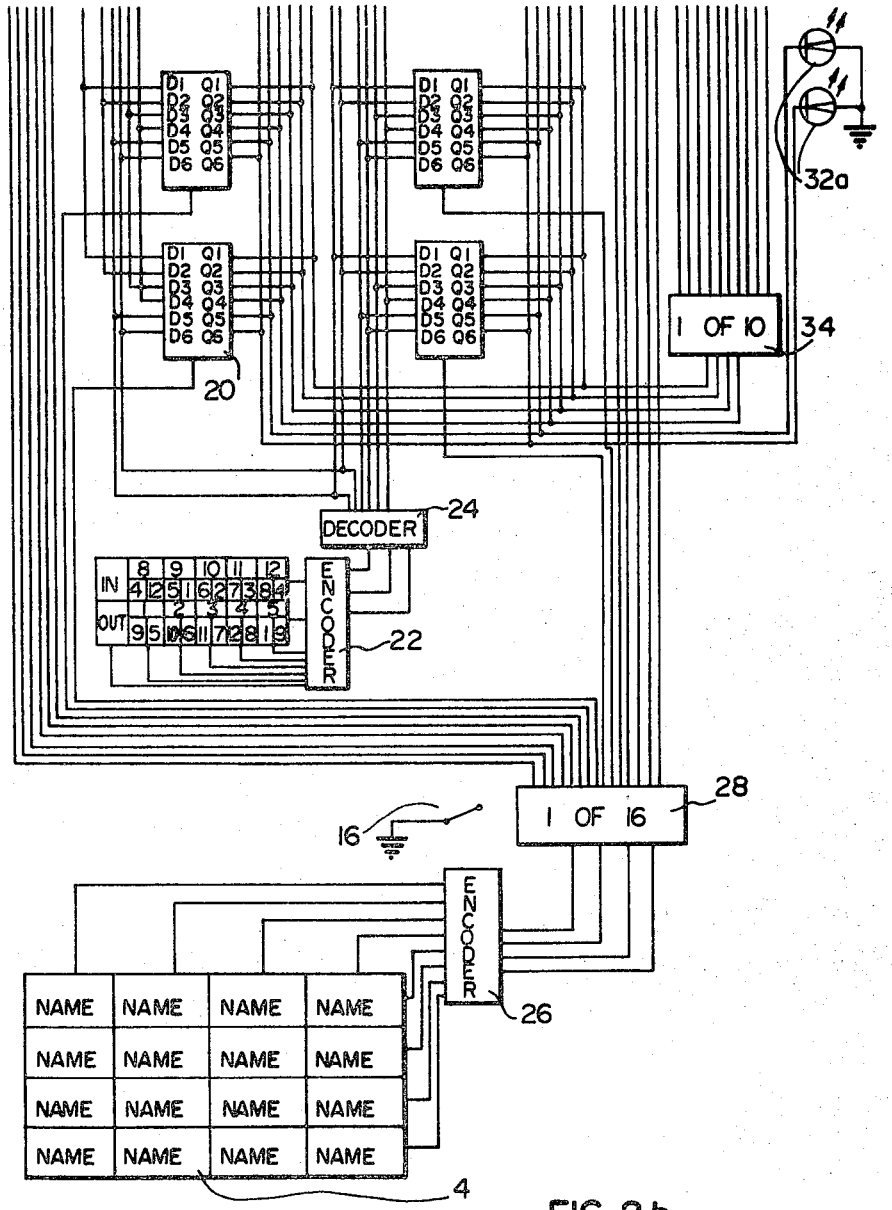

As can be seen from the circuit diagram of FIGS. 2a and 2b signals produced by the actuation of a particular personnel indicating switch 4, time indicating 6 and in or out indicating switch 12 are received and stored in appropriate memory means 20. The memory means comprises a series of latching circuits comprising D-type flip flops with output enabling and gating inputs (such as 74LS373). Each latch is enabled and gated by the selection of a particular personnel indicator switch 4. Signals from the time indicator switches 6 and in-out indicator switches 8 are passed to the relevant latching circuit corresponding to the designated person, and set that latching circuit to the proper output so as to display the named person's status. Encoder 22 takes the information from time indicator switches 6 and, by means of diode programming, converts the input to a binary weighted three line code as illustrated. Decoder 24 is a standard binary to octal decoder (such as N8250).

Similarly, encoder 26 takes the information from personnel indicating switches 4 and by means of diode programming, converts the input into a binary weighted four line code.

When it is desired to store name and time information in memory means 20, an appropriate name indicator switch 4 having been actuated, memory activation switch 16 is then actuated, thereby activating one of sixteen selector switch 28 which in turn activates appropriate latch 20 of the memory means, preparing it to receive in-out and time input signals from time indicating switches 6 and in-out indicating switches 8.

Where personnel time outside of the normal daytime working hours is to be stored and displayed on the device, time display means 10 may be set up for a 24 hour period, for example as illustrated in FIG. 1, convertable by rotary thumb wheel 30, to show a different time range. Provision has been made for this multiple range of times in the circuitry illustrated in FIGS. 2*a* and 2*b*.

As can be seen in FIG. 1, the device is further provided with display means comprising LED's 32 juxtaposed the time display means 10 and in-out displays 12. The appropriate latching circuit memory means 20 is thereby enabled and passes the information stored on it, to one of ten switch 34, a standard BCD to decimal decorder (such as 7442) whereby appropriate time display LED 32 is illuminated. In-out status information stored in memory means 20 is passed directly from the latch circuit to illuminate an appropriate in-out LED 32*a*.

In operation, power is turned on at on/off switch 40. Appropriate name indicting switch 4 is selected and memory activation switch 10 is selected. Appropriate in/out indicating switch 8 and appropriate time indicating switch 6 is then selected, for that particular series of displayed times, resulting in a display at LED's 32 and 32*a*, as to the presence or absence of that particular individual and the time at which he has arrived or departed. When another name is selected, the prior name is automatically entered into the memory, allowing a second name now to be entered. If the first name is desired at any moment thereafter the operator simply selects the appropriate name indicating switch 4. If "time" or "in-out" status has to be changed then the operator simply actuates memory activation switch 16, after the appropriate personnel indicating switch 4 has been actuated, and then actuating the required time indicating switch 6.

It will be readily appreciated that the call board according to the present invention can keep track of a much larger number of staff at any given time. It provides a means to enter and extract information simply by pressing a series of touch sensitive buttons or switches. The device can be situated on a desk or any other convenient place and takes up a minimal amount of apace.

Thus there has been described in accordance with the present invention a personnel call board that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. An electronic device for recording and displaying information regarding the arrival and departure of personnel at a location, comprising:

(a) a frame;

(b) a series of manually operable personnel indicating switches exposed on the frame, each of such switches representing a particular person or persons on different shifts in respect of which information is to be recorded or displayed, each of these switches only being actuable exclusively of the others;

(c) a further series of manually actuable time indicating switches exposed on the frame, each of such switches representing a particular time, and each of such switches only being actuable exclusively of the others;

(d) memory means electrically associated with the personnel indicating and time indicating switches to receive and store information received from these switches;

(e) means electrically associated with the memory means and personnel indicator switches, and actuable upon selection of a personnel indicating switch, to retrieve information stored in the memory means with respect to that person and display it at a time display means visibly located on the frame; and (f) switch means to actuate the information retrieval means.

2. An electronic device according to claim 1 further comprising in-out indicating switches electrically associated with the memory means to provide a signal thereto with respect to the presence or absence of a particular person, the memory means to additionally receive and store such signal received from such switches, the device further comprising in-out display means electrically associated with the memory means and information retrieval means, whereby such information stored in the memory means with respect to a particular person in-out status is visibly displayed upon actuation of the information retrieval means switch.

3. A device according to claim 2 wherein the memory means comprises a series of latching circuits, one for each person in respect of which information is to be recorded, each latching circuit to be output enabled and input gated by actuation of its corresponding personnel indicating switch.

4. A device according to claim 3 wherein each latch is a D-type flip flop.

5. A device according to claim 3 wherein the time indicating switches are momentary push-buttons which, when actuated, set the circuit of the latch for a particular selected person to the proper output so as to provide a corresponding time display at the time display means for that particular selected person.

6. A device according to claim 1 wherein the time display means consists of a series of LED's, one for each position in time sought to be displayed and corresponding to each of the time indicating switches.

7. A device according to claim 5 wherein the in-out display means comprises two LED's, one for "in" status and one for "out" status, and each corresponding to the respective in-out status selector switch.

* * * * *